United States Patent [19]

Saunders

[11] 4,106,306

[45] Aug. 15, 1978

[54] REFRIGERANT CHARGE ADJUSTER APPARATUS

[75] Inventor: James Fredrick Saunders, Onalaska, Wis.

[73] Assignee: The Trane Company, La Crosse, Wis.

[21] Appl. No.: 809,592

[22] Filed: Jun. 24, 1977

Related U.S. Application Data

[63] Continuation of Ser. No. 699,369, Jun. 24, 1976, abandoned.

[51] Int. Cl.[2] ..... F25B 45/00

[52] U.S. Cl. ..... 62/149

[58] Field of Search ..... 62/292, 149, 77; 236/78 D; 141/128, 198; 361/178; 318/482, 599

[56] References Cited

U.S. PATENT DOCUMENTS

| | | | |
|---|---|---|---|
| 2,752,498 | 6/1956 | Ehret | 236/78 D UX |
| 3,252,420 | 5/1966 | Sorensen | 318/482 X |
| 3,400,552 | 9/1968 | Johnson et al. | 62/149 |
| 3,591,077 | 7/1971 | Alton | 236/78 D |
| 3,645,496 | 2/1972 | Rawlins | 62/292 X |
| 3,875,755 | 4/1975 | Anderson et al. | 62/149 |

*Primary Examiner*—William E. Wayner
*Attorney, Agent, or Firm*—Carl M. Lewis

[57] ABSTRACT

Herein is disclosed an electronically controlled apparatus for accurately charging and/or venting refrigerant for an air conditioning system having an air cooled condenser and capillary tube control. The system includes means for stabilizing the sensed pressure values, means for rapidly charging a refrigeration system having a gross undercharge, means for automatically terminating the operation of the charge adjuster and means utilizing condenser heat to increase the speed at which refrigerant may be added to the refrigeration apparatus.

8 Claims, 2 Drawing Figures

CHARGE ADJUSTER LOGIC DIAGRAM

SECTION I
SECTION II
SECTION III
SECTION IV
SIGNAL HOLD
PTWB
RTS
RTA

REFRIGERANT CHARGE ADJUSTER APPARATUS

This is a continuation of application Ser. No. 699,369 filed June 24, 1976, now abandoned.

BACKGROUND OF THE INVENTION

It has long been known that the proper amount of refrigerant charge in compression cycle refrigeration-systems is essential to system reliability and efficiency. Numerous schemes for providing the proper charge of refrigerant to refrigeration systems have been disclosed such as in U.S. Pat. Nos. 3,400,552; 3,791,165; and 3,875,755. Overcharge often results in compressor slugging with attendant valve failure. Undercharge may result in reducing cooling capacity and for those system using refrigerant-cooled compressor motors, may result in motor overheating and burnout. Establishing the proper charge is most critical in refrigeration systems using a capillary tube type throttling means.

It has been the practice of manufacture to design refrigeration equipment so that when properly charged, refrigerant will return to the compressor with a predetermined degree of superheat, such as 15° F, where the refrigeration equipment is operated under certain standard conditions.

These standard conditions are often selected as 80° F dry bulb indoor temperature, 67° F wet bulb indoor temperature and 95° F dry bulb outdoor temperature.

When charging a refrigeration apparatus in the field it is not likely that these standard conditions will exist. Further, when refrigerant is added, transient pressure conditions exist which make it difficult to determine superheat by directly measuring suction line pressure.

SUMMARY OF THE INVENTION

The charge adjuster apparatus of the instant invention has for its principal object the provision of a charging apparatus for field charging capillary tube refrigeration systems accurately and rapidly to a predetermined standard charge.

A further object of this refrigeration charge adjuster apparatus is to provide means for remembering the refrigerant pressure during the period when transient pressure conditions would mislead the pressure sensing devices.

And a still further object of this invention is the provision of an automatic charge adjuster apparatus which automatically shuts off when proper charge is finally achieved.

More specifically this invention involves, a heat exchanger disposed in heat exchange relation to a refrigeration system condenser and having passages therein for conducting refrigerant passing from a temporarily connected refrigerant charging bottle to the refrigeration system being charged whereby heat from said refrigeration system condenser is utilized to vaporize refrigerant being added to said refrigeration system.

My invention also involves in a refrigerant charge adjuster apparatus, means for producing a signal which varies directly with said sensed saturation pressure, and means for temporarily substantially fixing the value of said signal during changes in saturation pressure due to changing the amount of refrigerant charge in said refrigeration system.

The invention further involves means for terminating the sequential opening of the charging valve or venting valve in response to a sensed condition including that the refrigeration system has been charged to a proper value.

Still further, my invention involves the combination of sequencing means for sequentially opening and closing a valve for admitting refrigerant charge and means for overriding said sequencing means to continuously charge refrigerant to the refrigeration system in response to a refrigerant pressure therein below a predetermined value.

Other objects and advantages of this invention will be more apparent as this specification proceeds to describe the invention with reference to the drawings.

DETAILED GENERAL DESCRIPTION

Figure 1:
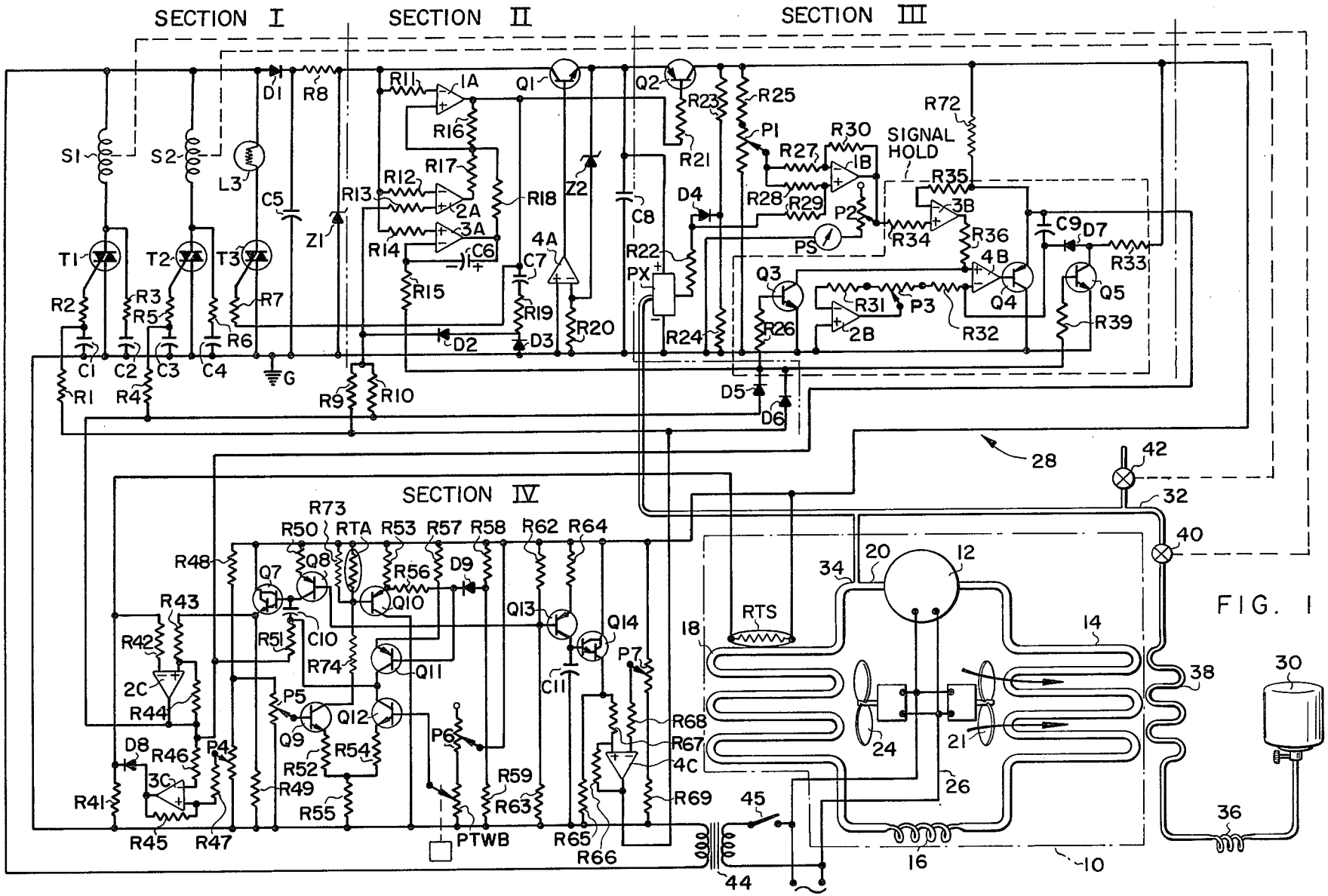
FIG. 1 is a schematic of a typical refrigeration system to be charged with the charging apparatus of my invention connected thereto.

The refrigeration system 10 (FIG. 1) to be charged includes a refrigerant compressor 12, an air cooled refrigerant condenser 14, a refrigerant throttling means in the form of a capillary tube 16 and a refrigerant evaporator 18 connected respectively in series in a closed loop 20.

The refrigerant system 10 further includes a condenser fan 21 and evaporator fan 24 each for passing air over its respective condenser and evaporator coils. A power circuit 26 is also included for connecting said evaporator fan 24, condenser fan 21 and compressor 12 to a source of electrical power.

The refrigerant adjuster apparatus 28 includes a source of REFRIGERANT 22 such as refrigerant bottle 30 connected through a conduit 32 to the suction line of the refrigeration system at 34. Conduit 32 includes an expansion means such as capillary tube 36, air to refrigerant heat exchanger 38, and normally closed charge solenoid valve 40. Capillary 36 limits the rate of flow of refrigerant and heat exchanger 38 utilizes hot air from the condenser 14 to vaporize refrigerant to be added to the refrigeration system. A vent pipe normally closed by normally closed vent solenoid valve 42 connects with conduit 32 downstream of valve 40 for venting excess refrigerant from the refrigeration system.

The only other necessary connections that are made with the refrigeration system to be serviced are the placement of suction line temperature sensing thermistor RTS in heat exchange relation to the suction line and the connection of step down transformer 44 via switch 45 to the A.C. electrical source to provide the charge adjuster control circuitry with 24 volts A.C. After the charger apparatus 28 is connected and the refrigeration system 10 is in operation, switch 45 is closed and the refrigeration system is charged automatically.

As previously noted, when charging refrigeration apparatus in the field, that is at the place of normal use, it is not possible that the aforementioned standard temperature conditions will exist.

However, for a properly designed and properly charged refrigeration system there exists a correlation between dry bulb outdoor temperature, indoor temperature and the desired refrigerant superheat at the compressor inlet. Since the evaporator coil is normally condensing moisture, the wet bulb temperature has a greater influence on the evaporator than the indoor dry bulb temperature. Therefore, the aforementioned correlation using the wet bulb indoor temperature in degrees Fahrenheit, the dry bulb outdoor ambient temperature in degrees Fahreheit, and refrigerant superheat is the operating basis for this automatic refrigerant charge adjusting apparatus. Thus, within the operating range of the charge adjuster, for any given dry bulb outdoor ambient temperature and any web bulb indoor temperature, the desired operating refrigeration superheat is predetermined. By providing an optional scale on the indoor temperature input potentiometer, dry bulb indoor temperature may be used in lieu of wet bulb indoor temperature wherein the optional scale assumes a 50% relative humidity. The automatic refrigerant charging apparatus charges refrigerant into, or vents refrigerant from the refrigeration system to achieve this desired predetermined degree of superheat.

The automatic refrigerant charging apparatus requires an input of outdoor dry bulb temperature, indoor dry or wet bulb temperature, suction line pressure, and suction line temperature, to either charge or vent refrigerant to or from the refrigeration system. In the instant automatic charging apparatus, the indoor dry or wet bulb temperature is manually read and the temperature signal fixed by adjusting a potentiometer in the control circuitry according to a dry or wet bulb scale, not shown. Since the control circuitry for the charge adjuster would normally be used outdoors adjacent the compressor-condenser unit, the manual input is convenient and low in cost. Obviously this input signal could be made automatic by extending wires indoors or the use of radio remote control.

Figure 2:
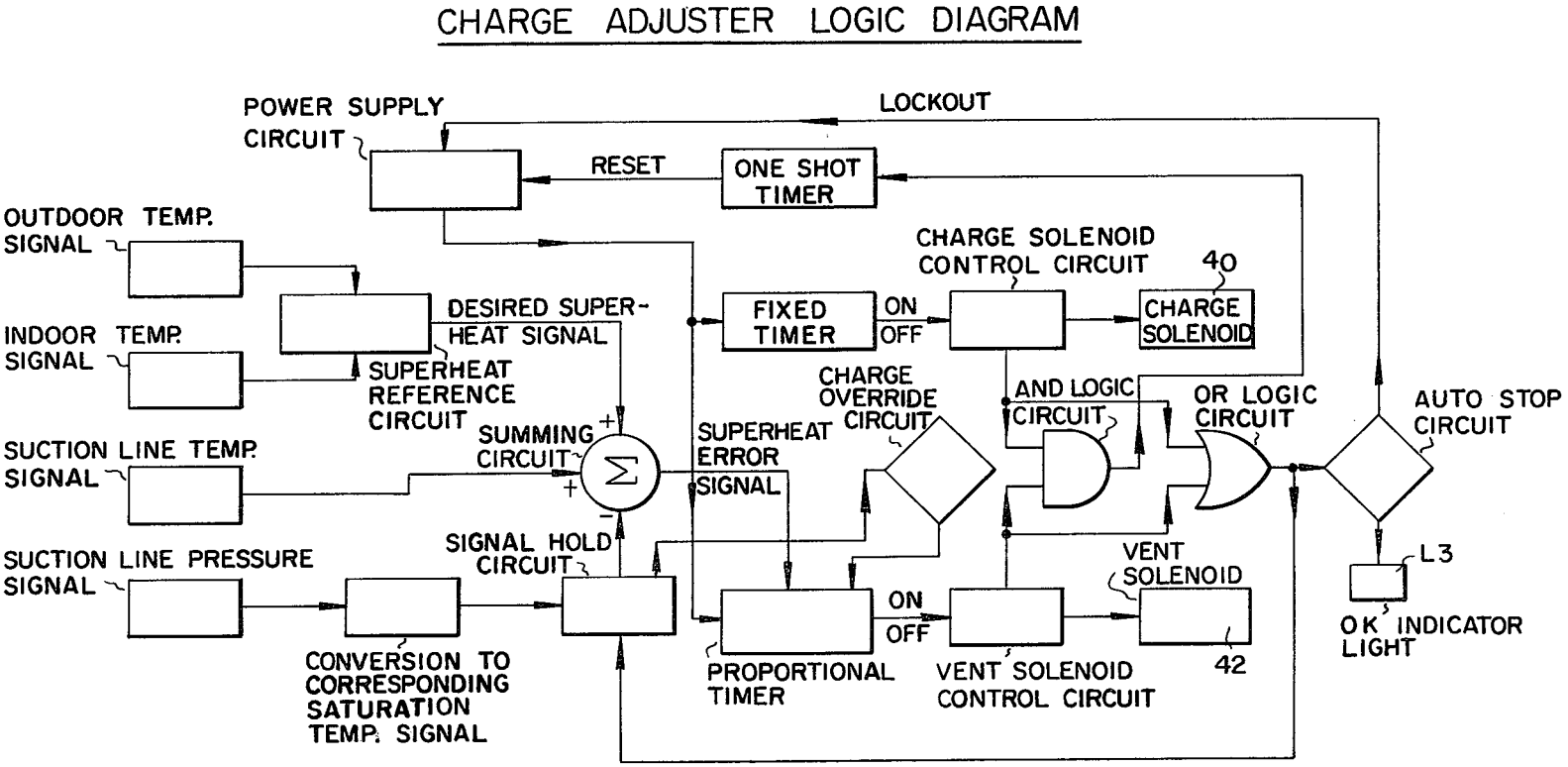
FIG. 2 is a logic circuit for the control circuitry of the charging apparatus shown in FIG. 1.

The logic of the signal processing is best understood by reference to FIG. 2. The Indoor Temperature Signal and the Outdoor Temperature Signal are fed into a Superheat Reference Circuit which has an output signal corresponding to the desired superheat for the indoor and outdoor temperature conditions.

In another portion of the circuitry the Suction Line Pressure Signal is converted to a Corresponding Saturataion Temperature Signal. The difference between this corresponding Saturation Temperature Signal and the Suction Line Temperature Signal thus represents the measured actual or operating superheat signal. A Summing Circuit compares the difference between the measured superheat signal and the desired superheat reference signal and produces a resultant Superheat Error Signal in the form of a positive or negative voltage supplied to the Proportional Timer. The logic circuitry described to this point is analogue in nature.

The aforementioned positive or negative voltage error signal thus represents the need for additional or reduced amounts of refrigerant. The Proportional Timer converts this analogue error signal to a digital signal producing a pulse of varying duration for operating the charge and vent solenoids 40 and 42 respectively, which, of course, must be either energized or de-energized.

The Power Supply Circuit, after being reset, transmits no power for a one-second interval. After this period power is supplied both to the Fixed Timer and to the Proportional Timer. The Fixed Timer produces no signal for a period of 15 seconds, after which it produces an ON signal. The Proportional Timer, when receiving a negative voltage error signal, produces an ON signal sooner than 15 seconds and, upon receiving a positive voltage error signal, produces an ON signal later than 15 seconds. Should there be no input voltage error signal to the Proportional Timer, the Proportional Timer will turn ON in 15 seconds. The output of the Fixed Timer is fed to the Charge Solenoid Control Circuit while the output of the Proportional Timer is fed to the Vent Solenoid Control Circuit. Whether or not the Charge Solenoid or the Vent Solenoid will be energized depends upon which timer is conducting and how soon the timer circuitry is reset.

The output signals from each of the Fixed and Proportional Timers is also fed to an AND Logic Circuit. At the point in time when both the Fixed and Proportional Timers are turned ON, i.e., conduct, an output signal from the AND Logic Circuit causes a One-Shot Timer or reset the Power Supply Circuit. After a one-second shutdown the power is again resupplied to the Fixed and Proportional Timers as aforementioned.

It will thus be evident that should the superheat error signal supplied to the Proportional Timer cause the Proportional Timer to turn ON before the 15-second reference time, the Vent Solenoid Control Circuit will energize the Vent Solenoid. Should the superheat error signal fed to the Proportional Timer cause the Proportional Timer to turn ON only after the 15-second reference time, then during the time interval from the 15-second reference point until the Proportional Timer is turned ON, the Charge Solenoid Control Circuit will energize the Charge Solenoid.

The Summing Circuit operates to determine the differential in changing temperature signal values simultaneously with the operation of either the charge or vent valves so that the valve open time is instantly responsive to the temperature signals and their differential determination. This system differs markedly from former systems wherein the temperature differential determining period and the valve open period follow one another successively in series wherein the preceeding temperature differential determining period each time precisely fixes the length of the succeeding valve open period for each cycle.

When either the Charge Solenoid or the Vent Solenoid is energized and open, a pressure transient will appear in the suction line pressure which would mislead the pressure evaluating circuitry. To prevent this from happening, a Signal Hold Circuit is provided. When either of the Fixed or Proportional Timers is conducting or when both the Fixed and Proportional Timers are conducting, the OR Logic Circuit produces a signal which causes Signal Hold Circuit to continue passing the substantially orginal signal until recycling of the timers. For purposes hereinafter discussed, the held original signal is the starting point for a predetermined slow ramp signal change. Thus the ramp signal held is fixed in relation to the orginal signal.

The OR Logic Circuit also has an output which is fed to an Auto-Stop Circuit. When the actual refrigerant superheat so closely approaches the desired superheat that the Fixed and Proportional Timers are for a period of about one minute producing average charge or vent signals of less duration than one second, the Auto-Stop Circuit produces a Signal which causes the Power Supply Circuit to be shut off and indicating that the refrigeration system is properly charged through an OR Indicator Light. Switch 45 is then opened and the charging apparatus 28 disconnected from the refrigeration system 10.

Because of the cycling nature of the refrigerant charging circuitry, that is because the charge solenoid is not open at all times when additional charge is required, considerable time would be required to bring a grossly undercharged refrigeration system to the proper charge. In order to shorten this time, a Charge Override Circuit is provided. This circuit, upon receiving a signal corresponding to suction saturation pressure of less than 40 lbs per square inch gauge from the Signal Hold Circuit, overrides the Proportional Timer to continuously energize the Charge Solenoid. It will be appreciated that if the signal from the Signal Hold Circuit were absolutely and indefinitely fixed at below 40 lbs per square inch gauge, the Charge Override Circuit would cause the Charge Solenoid to remain indefinitely open. So that this cannot occur, the Signal Hold Circuit has a slow ramp as aforementioned to cause the output signal thereof to very slowly indicate an increasing saturation pressure irrespective of the measured suction line pressure. Thus, when the held signal has slowly increased sufficiently to represent a suction line pressure of greater than 40 lbs per square inch gauge, the Charge Override Circuitry is de-activated, allowing the Signal Hold Circuit to evaluate a new pressure signal. Should the saturation pressure still be below 40 lbs per square inch gauge, the Charge Override Circuit will again be activated. Should the pressure be above 40 lbs per inch gauge, the circuit will continue under the control of the Fixed and Proportional Timers. The Charge Override Circuit substantially reduces the time required to charge refrigeration systems which have a gross undercharge.

DETAILED CIRCUIT DESCRIPTION

The parameters for the circuit components of FIG. 1 are shown in the table below:

| | |
|---|---|
| **CAPACITORS** | |
| C1 | 1.0Mf at 25V |
| C2 | .1Mf at 100V |
| C3 | 1.0Mf at 25 |
| C4 | .1Mf at 100V |
| C5 | 250Mf at 50V |
| C6 | 22Mf at 25V |
| C7 | 47Mf at 25V |
| C8 | 22Mf at 25V |
| C9 | .1Mf at 100V |
| C10 | 5Mf at 50V |
| C11 | .47Mf at 50V |
| **DIODES** | |
| D1 | 1N 4003 |
| D2 | 1N 4003 |
| D3 | 1N 4003 |
| D4 | 1N 4003 |
| D5 | 1N 4003 |
| D6 | 1N 4003 |
| D7 | 1N 4003 |
| D8 | 1N 4003 |
| D9 | 1N 4003 |
| **ZENER-DIODES** | |
| Z1 | 24V - 1 Watt |
| Z2 | 15V - 1 Watt |
| **POTENTIOMETER** | |
| P1 | 10K |
| P2 | 10K |
| P3 | 2M |
| P4 | 10K |
| P5 | 10K |
| P6 | 10K |
| P7 | 10K |
| **TRANSISTORS** | |
| Q1 | NPN 2N3904 |
| Q2 | PNP 2N3906 |
| Q3 | NPN 2N3904 |
| Q4 | PNP 2N3906 |
| Q5 | NPN 2N3904 |
| Q7 | MPS - A12 MOT |
| Q8 | PNP 2N 3906 |

-continued

| | |
|---|---|
| Q9 | NPN 2N3904 |
| Q10 | PNP 2N3906 |
| Q11 | PNP 2N3906 |
| Q12 | NPN 2N3904 |
| Q13 | PNP 2N3906 |
| Q14 | MPS - A12 MOT |
| **TRIACS** | |
| T1 | 2N6069B - MOT |
| T2 | 2N6069B - MOT |
| T3 | 2N6069B - MOT |
| **RESISTORS** | |
| R1 | 1K |
| R2 | 2.2K |
| R3 | 100Ω |
| R4 | 1K |
| R5 | 2.2K |
| R6 | 100Ω |
| R7 | 2.2K |
| R8 | 200Ω |
| R9 | 100K |
| R10 | 100K |
| R11 | 470K |
| R12 | 191K |
| R13 | 39K |
| R14 | 1M |
| R15 | 20K |
| R16 | 1M |
| R17 | 100K |
| R18 | 470K |
| R19 | 1.2 |
| R20 | 680Ω |
| R21 | 10K |
| R22 | 2K |
| R23 | 20.5K |
| R24 | 8.2K |
| R25 | 10K |
| R26 | 39K |
| R27 | 100K |
| R28 | 270K |
| R29 | 100K |
| R30 | 270K |
| R31 | 10M |
| R32 | 10M |
| R33 | 39K |
| R34 | 1M |
| R35 | 1M |
| R36 | 20K |
| R39 | 39K |
| R41 | 10.0K |
| R42 | 1M |
| R43 | 1M |
| R44 | 10M |
| R45 | 10M |
| R46 | 100K |
| R47 | 100K |
| R48 | 10K |
| R49 | 10K |
| R50 | 2M |
| R51 | 10K |
| R52 | 2.7K |
| R53 | 10K |
| R54 | 5.1K |
| R55 | 1.0K |
| R56 | 3.32K |
| R57 | 6.65K |
| R58 | 10.0K |
| R59 | 35.7K |
| R62 | 10K |
| R63 | 100K |
| R64 | 1.5M |
| R65 | 10K |
| R66 | 10M |
| R67 | 1M |
| R68 | 1M |
| R69 | 10K |
| R72 | 10K |
| R73 | 21K |
| R74 | 4.12K |
| **AMPLIFIERS** | |
| 1A, 2A, 3A, 4A | LM3900* |
| 1B, 2B, 3B, 4B | LM3900* |
| 2C | |

-continued

| | |
|---|---|
| 3C<br>4C | LM3900* |

*National Semi Conductor Corporation 2900 Semi Conductor Drive Santa Clara, California The control circuits shown in FIG. 1 is for purposes of this disclosure divided by double-dot-dash lines into four major sections. Section I is the Power Circuit; Section II, the Decoder and Regulator Circuit; Section III, the Input Circuit; and Section IV, the Reference Circuit.

Section I shows the extreme left-hand portion of the total circuit and is called the power circuit. Included in this portion of the circuit is the triac T1 which controls the solenoid coil of S1 of charge solenoid valve 40. Triac T2 controls the solenoid coil S2 of vent solenoid valve 42. Triac T3 energizes the O.K. indicator light L3. Resistors R1, R2, R4, R5, and R7 limit the gate current to those triacs. Capacitors C1 and C3 provide the time-delay, preventing solenoid valve operation prior to reset. Resistors R3 and R6 coupled with capacitors C2 and C4 prevent false triggering of triacs T1 and T2 due to their inductive loads. Diode D1 and capacitor C5 form the D.C. power supply, which is regulated to 24 volts D.C. by resistor R8 and zener diode Z1.

In the decoder and regulator circuit, Section II, transistor Q1 and the operational amplifier 4A coupled with the zener diode Z2 and resistor R20 regulate the output to 15 volts D.C. Capacitor C8 eliminates any ripple in this 15 volt D.C. supply which provides power to the input and reference circuitry. Transistor Q2 and resistor R21 provide the shut off capability of the power supply during reset or lockout. Diodes D5 and D6 make up the OR Logic Circuit and resistors R9 and R10 coupled with resistors R13, R12, and the operational amplifier 2A comprise the AND Logic Circuit. Resistors R15 and R14 coupled with operation amplifier 3A and capacitor C6 integrate the charge and vent pulse duration. Resistors R11, R16, R17, and R18 when connected to operational amplifier 1A provide the switching functions necessary to lock out or reset the timers via transistor Q2 and resistor R21. Capacitor C7, resistor R19, and diodes D2 and D3, provide the one-second, one-shot reset time duration. Resistor R7 (See Section I), is powered by operational amplifier 1A during reset or lockout to energize triac T3 and the O.K. light L3.

Portions of Section II function as part of the valve sequencing means which function as follows: Operational amplifier 4C produces the output signal as the fixed timer (See logic diagram of FIG. 2), while operational amplifier 2C produces the output signal as the proportional timer. Operational amplifier 4C turns on fifteen seconds after being reset. Operational amplifier 2C turns on between 0 and 15 seconds after being reset if venting is required, or sometime after 15 seconds after being reset if charging is required. The instant both timers are simultaneously on, sufficient current is passed via resitors R9 and R10 (the AND logic circuit of FIG. 2) and resistor R13 to turn on operational amplifier 2A which in turn passes a signal through resistor R17 to operational amplifier 1A causing it to turn on and pass a signal through resistor R21 to the base of transistor Q2 whereupon Q2 is turned off to shut off the D.C. power to Sections III and IV to terminate the timing functions therein. At this instant, no signal can be generated by operational amplifiers 2C and 4C and thus there is no signal passing through resistors R9 and R10 to maintain operational amplifier 2A on. However, to give the timing circuits sufficient time to de-energize, current flows for about one second in a circuit from the output of operational amplifier 1A including capacitor C7, resistor R19, diode D2 and resistor R13 to the positive side of operational amplifier 2A thereby holding via operational amplifier 1A, transistor Q2 in the off condition. After about one second, capacitor C7 becomes charged and the current flowing through resistor R13 becomes less than the current flowing in resistor R12 which causes operational amplifier 2A to turn off which turns off operational amplifier 1A which then turns transistor Q2 on to resume power to Section III and IV of the circuit and a new timing cycle is started. The process repeats itself with the amount of vent or charge time per cycle decreasing as the proper refrigerant charge is approached as hereinafter described.

The Auto-stop means is in Section II and functions as follows: The Auto-stop means includes diodes D5 and D6, resistors R14, R15, R18 and R21, transistor Q2, operational amplifiers 1A and 3A and associated circuit connections. During those periods when neither a charge signal nor vent signal is being generated capacitor C6 will be slowly charged via amplifier 3A. However, when either a charge or vent signal is generated, one of diodes D5 or D6 (the OR logic circuit of FIG. 2) will pass this signal through resistor R15 to discharge capacitor C6 by means of amplifier 3A. When the charge or vent signals are of sufficiently short duration so that discharging of capacitor C6 is less than the charging of capacitor C6, the voltage on capacitor C6 and amplifier 3A will rise to a predetermined level sufficient so that through resistor R18 operational amplifier 1A is turned on which in turn delivers a signal through resistor R21 to the base of transistor Q2 which is thus turned off. This turns off the D.C. power to Sections III and IV of the circuit so no further charge or vent signals can be generated. Aside from cutting all power to the circuit by switch 45, the only way that the voltae on operational amplifier 3A can be reduced sufficiently below the predetermined level, is by a charge or vent signal passing through either of diodes D5 or D6. Since such signals can't be generated as long as the voltage on operational amplifier 3A remains above the predetermined level, Sections III and IV remain automatically locked out and no charge or vent signals can be generated despite changes in the temperature at thermistor RTS or pressure at pressure transducer PX.

The input circuit shown in Section III processes the suction pressure input signal and suction temperature signal. The pressure transducer circuit PX which converts the suction pressure P from pounds per square inch gauge into a voltage signal V according to the formula $V = 0.0333 \times P + 2.5$, takes its power via transistor Q1 (See Section II). Resistors R22, R23, and R24 coupled with diode D4 shape the output signal and convert it to a saturated temperature signal. This saturated temperature signal is further processed by Resistors R25, P1, R27, R28, R29, R30, and operational amplifier 1B. Potentiometer P1 adjusts the reference voltage and calibrates the saturated temperature signal. The resultant saturated pressure voltage is entered into the suction pressure meter PS (when used) by means of potentiometer P2. Potentiometer P2 is used to calibrate the suction pressure meter PS. The negative temperature coefficient suction temperature input thermistor RTS coupled with resistors R11 and R12 produce a voltage proportional to suction temperature. The parameters of RTS and RTA may be the same and are selected on the basis of the aforementioned correlation between indoor and outdoor temperatures and desired superheat.

The signal hold circuitry is shown in the circuit portion enclosed by the dashed line. The signal hold circuit functions as follows: When the OR Logic Circuit is off, no current is supplied from diodes D5 and D6 (See Section II) through resistors R26 and R39 leaving transistors Q3 and Q5 off. When transistors Q3 and Q5 are off, the saturated suction temperature voltage is processed by resistors R34, R35, and R36 when coupled with operational amplifiers 3B and 4B. The output of operational amplifier 4B is again amplified and buffered by resistor R72 and a transistor Q4, whose emitter output is the final saturated suction temperature voltage, which goes to R46 (See Section IV). Diode D7 and resistor R33 supply a bias current to the negative input of amplifier 4B when transistor Q5 is off. When the OR Logic Circuit is on, current is supplied through resistors R26 and R39 which saturate and turn on transistors Q3 and Q5. When transistors Q3 and Q5 are on, the supply current to amplifier 4B is no longer available and amplifier 4B will register the voltage present on capacitor C9. The voltage present on capacitor C9 was the output saturated suction temperature voltage prior to activation of the OR Logic Circuit. Operational amplifiers 2B and resistors R31, R32, and P3 are active only during the hold operation. Trimming resistor P3 can be adjusted to provide a linear increase in the output voltage signal with time, during hold.

The reference circuit shown in Section IV generates the reference signals and also provides the fixed and proportional timing functions. The fixed timing circuit is shown on the far right of Section IV. Resistors R62, R63, and R64 together with transistor Q13 provide a fixed current source which flows into capacitor C11 raising the capacitor voltage linearly with time. The linearly increasing voltage on capacitor C11 is transferred by transistor Q14 to resistors R65 and R67. Resistors R68, R69, and P7 form a reference voltage signal. Operation amplifier 4C compares the voltage on capacitor C11 with this reference voltage. When the voltage on capacitor C11 exceeds the reference voltage, amplifier 4C turns on. Potentiometer P7 can be used to adjust this fixed time during calibration.

The proportional timer is similar to the fixed timer in operation except that the voltage on the negative side of the ramp capacitor C10 varies in value. The current supply for capacitor C10 on the proportional timer is made up of the same resistors R62 and R63 used in the fixed timer, but uses resistor R50 and transistor Q8 to supply a fixed current source to the ramp capacitor C10. The voltage on the ramp capacitor C10 is mirrored by transistor Q7 and supplied to resistors R49 and R43. The voltage between resistors R41 and R42 is proportional to suction temperature. Operational amplifier 2C will turn on when the voltage on capacitor C10 exceeds the suction temperature voltage. Therefore, the proportional timer will turn on when the ramp voltage on capacitor C10 exceeds the suction temperature voltage from resistors R41 and R42. The hysteresis resistors R44 and R66 are used in both timers to insure that a very rapid turn on time with hysteresis is present in both timers. The center portion of the reference circuit shown in Section IV produces the desired superheat reference voltage.

The following components comprise the circuit that enters the outdoor ambient signal: Resistors R48, P5, R52, R55, R53, R56, R57, R58, R59, R73 and R74; transistors Q8, Q9, Q10, and Q11; thermistor RTA; and diode D9. The outdoor temperature reference circuit functions as follows: Resistors R48, P5, R52, and R55 together with transistor Q9 provide a current sink for suction temperature input signal thermistor RTA. Trimming resistor P5 is used to adjust the magnitude of the outdoor thermistor signal. Resistors R73 and R74 shape the signal curve of thermistor RTA. The voltage drop across negative coefficient thermistor RTA is mirrored by transistor Q10 and transferred to resistors R53 and R56. Diodes D9, together with resistors R48, and R59, shape the signals. Transistor Q11 and R57 produce a current corresponding to the outdoor ambient temperature characteristics.

The indoor conditions are entered through potentiometer P6 and indoor temperature signal input potentiometer PTWB, transistor Q12 and resistors R54 and R55. Trimming resistor P6 is used to adjusted the range of potentiometer PTWB. These components produce a current at the collector of transistor Q12 sufficient to shift the reference voltage according to the indoor condition.

The difference between the collector current of transistor Q11 and Q12 flows through resistor R51 to capacitor C9 and finally to ground via transistor Q4. The voltage produced across resistor R51, due to this difference in current, represents a voltage proportional to the required superheat for the outdoor temperature and indoor temperature inputs. When the refrigeration system is properly charged, the voltage at the negative side of capacitor C10 is equal to the voltage between resistors R41 and R42. The voltage drop from base to emitter on transistor Q7 is equal to approximately 1.1 volts. This voltage is the final triggering voltage of capacitor C10 when the unit is properly charged. Since the fixed or reference timer is fixed at 15 seconds duration, the voltage ramp on capacitor C10 must, therefore, increase from 0 to 1.1 volts in 15 seconds.

If the measured superheat voltage is greater than the reference superheat voltage, capacitor C10 will take longer to charge due to this higher voltage level; thereby allowing a charge pulse since the fixed timer energizes the charge solenoid valve. If the measured superheat is less than the reference superheat voltage, capacitor C10 will be required to charge to a smaller voltage level or perhaps will be sufficiently charged after reset to immediately turn on the amplifier 2C which will then energize the vent solenoid valve immediately after reset. In either case, having a measured superheat signal less than the reference superheat signal will cause the charge adjuster apparatus to vent refrigerant from the air conditioning system.

Refrigerant charging of systems having a gross inadequate charge is speeded by amplifier 3C and the following components: Diode D8 and resistors R41, R45, R46, R47, R48, and P4. When the measured suction pressure is equal to 40 psig, the saturated system temperature signal is equal to 2 volts. By setting trimming resistor P4 equal to 2 volts at its center top, amplifier 3C will force amplifier 2C to be off until the saturated suction temperature signal is equal to or greater than 2 volts. With amplifier 2C forced into the off state, the unit will continue to charge continuously until amplifier 3C has been turned off by a suction pressure greater than 40 psig. The slow increase in output voltage signal of the Signal Hold Circuit as aforementioned insures that the Override Circuit will see 40 psig so that the Signal Hold Circuit does not function to indefinitely hang up in the overriding mode. When amplifier 3C is off, diode D8 prevents current from leaking through amplifier 3C to ground.

It will thus be seen that I have provided a refrigerant charge adjuster apparatus for use with an air cooled refrigeration system using capillary tube throttling means. The system has provision for stabilizing the sensed pressure values during transient fluctuation of pressure when refrigerant is charged or vented. The system includes means for more rapidly adding refrigerant by heating the refrigerant with condenser heat and by continuously charging refrigeration systems with a gross undercharge below 40 psig. The system has provision for automatically terminating when the proper charge is finally met.

It will be appreciated that there are many changes that may be made without departing from the scope and spirit of my invention and I accordingly desire to be limited only by the claims:

I claim:

1. In a refrigerant charge adjuster apparatus for adjusting the charge in a refrigeration system, and having means for determining the actual superheat by at least sensing the refrigerant saturation pressure of said refrigeration system, the improvement including: means for sensing the refrigerant saturation pressure of said refrigeration system, means for producing a signal which varies directly with said sensed saturation pressure, and means for temporarily substantially fixing the value of said signal during charge adjustments in said refrigeration system.

2. The refrigerant charge adjuster apparatus as defined by claim 1 including means to slowly change said substantially fixed signal value to indicate a slowly increasing saturation pressure irrespective of the actual changes in saturation pressure.

3. The refrigerant charge adjuster apparatus as defined by claim 1 wherein said saturation pressure is the suction pressure of said refrigeration system.

4. In a refrigerant charge adjuster apparatus for adjusting the refrigerant charge in a refrigeration system, and having means for determining the actual superheat by at least sensing the refrigeration system saturation pressure, the improvement comprising: means for producing a signal which varies directly with said sensed saturation pressure, sequencing means for suqentially opening and closing a valve for admitting refrigerant charge from a temporarily connected charging bottle to said refrigeration system in response to the deviation of said sensed pressure from a predetermined value, means for temporarily substantially fixing the value of said signal during changes in saturation pressure due to changes in the amount of charge in the refrigeration system, override means overriding said sequencing means to continuously hold said valve open to charge refrigerant to said refrigeration system in response to a pressure therein below a predetermined value, whereby the charging speed of a grossly undercharged refrigeration system is accelerated, and means for slowly changing the value of said substantially fixed signal to indicate a slowly increasing saturation pressure irrespective of the actual changes in actual saturation pressure whereby said override means is not activated for an indefinite time.

5. In a refrigerant charge adjuster apparatus for adjusting the refrigerant charge in a refrigeration system, the combination of: valve sequencing means for periodically opening a valve for admitting refrigerant charge from a temporarily connected refrigerant charging bottle to said refrigeration system in response to a sensed condition of the refrigeration system; and auto-stop means for automatically locking said sequencing means out of operation in response to said sensed condition of said refrigeration system having attained a predetermined condition whereby further changes in said sensed condition will not reactivate said valve sequencing means irrespective of the further changes of said sensed condition.

6. The apparatus as defined by claim 5 wherein the length of the periods for which said valve is opened is responsive to the deviation of said sensed condition from a predetermined value.

7. The apparatus as defined by claim 6 wherein said sensed condition is a signal corresponding to actual superheat value of the refrigerant in said refrigeration system and said predetermined value is a signal corresponding to a predetermined desired superheat value.

8. The apparatus as defined by claim 7 wherein said predetermined condition is a refrigeration system charge condition wherein the valve open periods decrease to an average duration below a set predetermined value in excess of zero.

* * * * *